US012467361B2

(12) United States Patent
Rataj et al.

(10) Patent No.: US 12,467,361 B2
(45) Date of Patent: Nov. 11, 2025

(54) DOUBLE-WEDGE ROCK BOLT

(71) Applicant: SANDVIK MINING AND CONSTRUCTION AUSTRALIA (PRODUCTION/SUPPLY) PTY LTD, Queensland (AU)

(72) Inventors: Mietek Rataj, New South Wales (AU); Bradley Darlington, New South Wales (AU); Warren Roach, New South Wales (AU)

(73) Assignee: Sandvik Mining and Construction Australia (Production/Supply) Pty Ltd, Milton (AU)

( * ) Notice: Subject to any disclaimer, the term of this patent is extended or adjusted under 35 U.S.C. 154(b) by 136 days.

(21) Appl. No.: 18/294,526

(22) PCT Filed: Aug. 1, 2022

(86) PCT No.: PCT/AU2022/050822
§ 371 (c)(1),
(2) Date: Feb. 1, 2024

(87) PCT Pub. No.: WO2023/010159
PCT Pub. Date: Feb. 9, 2023

(65) Prior Publication Data

US 2024/0287903 A1 Aug. 29, 2024

(30) Foreign Application Priority Data

Aug. 5, 2021 (EP) ..... 21189971

(51) Int. Cl.
*E21D 21/00* (2006.01)

(52) U.S. Cl.
CPC ..... *E21D 21/004* (2013.01); *E21D 21/0033* (2013.01); *E21D 21/008* (2013.01)

(58) Field of Classification Search
CPC .. E21D 21/004; E21D 21/0033; E21D 21/008
See application file for complete search history.

(56) References Cited

U.S. PATENT DOCUMENTS

| | | | | |
|---|---|---|---|---|
| 4,342,527 | A * | 8/1982 | White | E21D 21/0093 411/24 |
| 4,656,806 | A | 4/1987 | Liebhard et al. | |
| 2007/0031196 | A1 * | 2/2007 | Bruneau | E21D 21/004 405/262 |
| 2020/0063556 | A1 | 2/2020 | Darlington et al. | |

FOREIGN PATENT DOCUMENTS

| | | | | |
|---|---|---|---|---|
| CZ | 25706 | U1 | 7/2013 | |
| GB | 827276 | A | 2/1960 | |
| WO | 02081866 | A1 | 10/2002 | |
| WO | 2010104460 | A | 9/2010 | |
| WO | 201513743 | A1 | 2/2015 | |
| WO | 2017/120633 | A1 | 7/2017 | |
| WO | 2018206628 | A1 | 11/2018 | |
| WO | WO-2021012021 | A1 * | 1/2021 | E21D 21/0046 |

* cited by examiner

*Primary Examiner* — Kyle Armstrong
(74) *Attorney, Agent, or Firm* — Corinne R. Gorski

(57) ABSTRACT

A rock bolt includes a wedge-based expansion mechanism. The expansion mechanism includes a drive wedge arranged to expand an intermediate wedge upon tensioning of the rock bolt, wherein the intermediate wedge is arranged to expand a wedge device attached to an outer tube of the rock bolt. The use of the intermediate wedge enables greater expansion of the rock bolt.

15 Claims, 7 Drawing Sheets

DOUBLE-WEDGE ROCK BOLT

RELATED APPLICATION DATA

This application is a § 371 National Stage Application of PCT International Application No. PCT/AU2022/050822 filed Aug. 1, 2022 with priority to EP 21189971.1 filed Aug. 5, 2021.

TECHNICAL FIELD

The present disclosure relates to bolts for reinforcement of formations, such as rock strata, and specifically to technology for promoting easier installation and pre-tensioning of such bolts.

BACKGROUND

Formations, such as rock formations or rock strata, are often reinforced using rock bolts. For example, rock bolts are commonly used for reinforcement of tunnel roofs and for stabilization of rock walls, slopes and dikes. Various types of rock bolts or anchors are used depending for example on the type of formation to be reinforced.

A common type of rock bolt is the hydraulically expandable rock bolt provided with an expandable body to be driven into a formation and thereafter expanded by introduction of a pressurized pressure medium such that the expandable body presses against the wall of the borehole and thereby engages the formation. A hydraulically expandable rock bolt is known from CZ 25706 U1.

Another type of rock bolt is the friction bolt. Such a rock bolt may be driven into a formation by a driving device such as a jumbo. A derivative of the friction bolt is the mechanically expandable bolt, comprises an elongate expandable outer body, sometimes referred to as a split-tube, and a central rod extending inside the outer body from a trailing portion provided with a nut to a leading portion operatively connected to an expansion mechanism for expanding the outer body upon rotation of the central rod.

At installation of the mechanically expandable rock bolt in the formation, the driving device is operated to repeatedly impact the outer body of the bolt, thereby forcing the outer body into the formation. When the bolt is sufficiently driven into the formation the bolt is expanded by operation of the expansion mechanism thereby causing expansion of the outer body.

AU2010223134B2 discloses a mechanically expandable friction bolt.

EP3635220 A1 and WO201513743 disclose prior art mechanically expandable rock bolts.

Sometimes, the bolt is not properly anchored to the formation despite maximum expansion of the expansion mechanism.

SUMMARY

An object of the invention is thus to mitigate the above-mentioned problem by enabling a greater expansion range of the rock bolt.

According to a first aspect of the invention, these and other objects are achieved by the rock bolt defined in the appended independent claim 1 with alternative embodiments defined in the dependent claims.

The rock bolt comprises a central rod, a tubular outer body provided around the central rod along at least a portion of the length of the central rod, and an expansion mechanism for radially expanding the tubular outer body tube.

The expansion mechanism comprises a first wedge means attached to the central rod, and a second wedge means attached to the outer body between the first wedge means and a trailing portion of the outer body.

The first wedge means and the second wedge means are configured such that the first wedge means is able to force the second wedge means radially outwards about the longitudinal axis of the rock bolt upon movement of the first wedge means in a first direction towards a trailing portion of the rock bolt rod to thereby radially expand the outer body.

The first wedge means comprises a drive wedge attached to the central rod and an intermediate wedge provided around at least a portion of the drive wedge, between the drive wedge and the second wedge means, wherein the drive wedge and the intermediate wedge are configured such that the drive wedge is able to radially expand the intermediate wedge upon movement of the drive wedge in the first direction towards a trailing portion of the rock bolt, wherein first wedge means is thus able to force the second wedge means radially outwards with the radially expanded intermediate wedge.

The drive wedge may be provided with first wedge surfaces and with second wedge surfaces for interfacing the first wedge surfaces of the drive wedge.

The first wedge surfaces may according to alternative a) be planar and the second wedge surfaces may be planar. Alternatively, according to alternative b), the first wedge surfaces may have a first cross-sectional shape S being constant along the length of each respective first wedge surface, wherein the second wedge surfaces have a constant second cross-sectional shape S being constant along the length of each respective second wedge surface, and wherein the first cross-sectional shape fits with the second cross-sectional shape.

The interfacing wedge surfaces of the drive wedge and of the intermediate wedge enable an elongate contact surface between the drive wedge and the intermediate wedge as the drive wedge is moved further into the intermediate wedge to force the intermediate wedge to expand. As the shanks of the intermediate wedge bend and/or deform the regions of contact of the primary and intermediate wedges move. If a conical drive wedge surface would have been used, point pressures would arise as the drive wedge moves into the intermediate wedge.

If the rock bolt is according to alternative b, the first and second wedge surfaces may all have constant cross-sectional shape perpendicularly to the longitudinal axis of the rock bolt, i.e. the cross-sectional shape as seen in a cross-section defined by a plane perpendicular to the longitudinal axis of the rock bolt.

The intermediate wedge may be provided with one or more outer wedge surfaces comprising a tapering lead-in portion and a rear portion extending along the longitudinal axis of the rock bolt.

The tapering front portion enables proper alignment of the intermediate wedge to the second wedge means upon movement of the first wedge means in the driving direction of the drive wedge.

The rear portion may be shaped such that when the intermediate wedge is fully expanded the rear portion is aligned with the lead-in portion.

The alignment enables a substantially linear expansion of the outer body as the first wedge means moves in the first direction.

The intermediate wedge may be provided with one or more outer wedge surfaces tapered along a majority of the length of the intermediate wedge.

The drive wedge may comprise at least one shoulder for applying driving force to the intermediate wedge to force the intermediate wedge in the first direction.

Upon forcing the drive wedge into the intermediate wedge, the intermediate wedge is supported from one side by the second wedge means attached to the outer tube and forced from its other side by wedge surfaces of the drive wedge. Upon expansion of the intermediate wedge it eventually abuts the shoulder of the drive wedge such that additional driving force may be transmitted at the interface between the shoulder and the intermediate wedge without causing further expansion of the intermediate wedge. This enables improved control of the amount of expansion of the intermediate wedge and enables increased force to be applied to the intermediate wedge.

The shoulder may be configured to enable the intermediate wedge to move relatively the drive wedge from an unexpanded position to an expanded position, and configured to provide a stop surface preventing further relative movement of the intermediate wedge onto the drive wedge past the expanded position.

The shoulder thus engages the intermediate wedge first when the intermediate wedge has reached its expanded position, thereby enabling the driving force of the drive wedge to primarily expand the intermediate wedge until the intermediate wedge is fully expanded to specifications. If no such shoulder is provided on the drive wedge, further expansion of the intermediate wedge would be possible, thereby enabling further expansion of the second wedge means.

The intermediate wedge may be made in one piece.

A one-piece design of the intermediate wedge enables easier assembly of the rock bolt.

The intermediate wedge may comprise a plurality of wedge parts distributed about the longitudinal axis of the rock bolt.

A multi-piece design of the intermediate wedge enables greater manufacturing tolerances and enables use of the wedge parts for different sizes of rock bolts with different sizes of central rods.

The intermediate wedge may comprise resilient retaining means configured to longitudinally align the wedge parts with respect to the longitudinal axis of the rock bolt and configured to allow the wedge parts to radially expand.

The retaining means keeps the intermediate wedge parts grouped together and thus enables easier assembly of the rock bolt.

The retaining means may comprise one or more resilient circumferential bands extending about the longitudinal axis of the rock bolt and engaging respective corresponding recesses of the wedge parts, said resilient bands for example being O-rings.

The resilient bands provide a simple and robust means of keeping the intermediate wedge parts grouped together and is detachable and replaceable if damaged during assembly or handling of the rock bolt.

The intermediate wedge may be provided with a shoulder at its rear portion for limiting the axial movement of the intermediate wedge along the longitudinal axis of the rock bolt by engagement of the second wedge means.

The intermediate wedge and the drive wedge are configured such that at least a portion of the intermediate wedge upon being expanded by the drive wedge abuts the outer body to thereby radially expand the outer body upon further expansion of the intermediate wedge.

BRIEF DESCRIPTION OF DRAWINGS

FIG. 2*b* shows the rock bolt in cross-section.

FIG. 3*b* show the intermediate wedge in cross-section.

| | |
|---|---|
| 1 | rock bolt |
| 2 | central rod |
| 3 | shoulder of intermediate wedge |
| 4 | tubular outer body |
| 5 | retaining means |
| 6 | first wedge means |
| 7 | second wedge means |
| 8 | drive wedge |
| 9 | intermediate wedge |
| 10 | first wedge surfaces |
| 11 | second wedge surfaces |
| 12 | shoulder of drive wedge |
| 13 | lead-in portion |
| 14 | rear portion |
| 15 | longitudinal axis of rock bolt |
| 16 | wedge parts |
| 17 | outer wedge surfaces |
| 18 | trailing portions |
| 19 | rear portion of intermediate wedge |
| S1 | first cross-sectional shape |
| S2 | second cross-sectional shape |
| D | first direction |
| L1 | shorter length of outer wedge surface of intermediate wedge |
| L2 | longer length of outer wedge surface of intermediate wedge |

DETAILED DESCRIPTION

A rock bolt 1 according to an exemplary embodiment will hereinafter be described with reference to the appended drawings.

Figure 1:
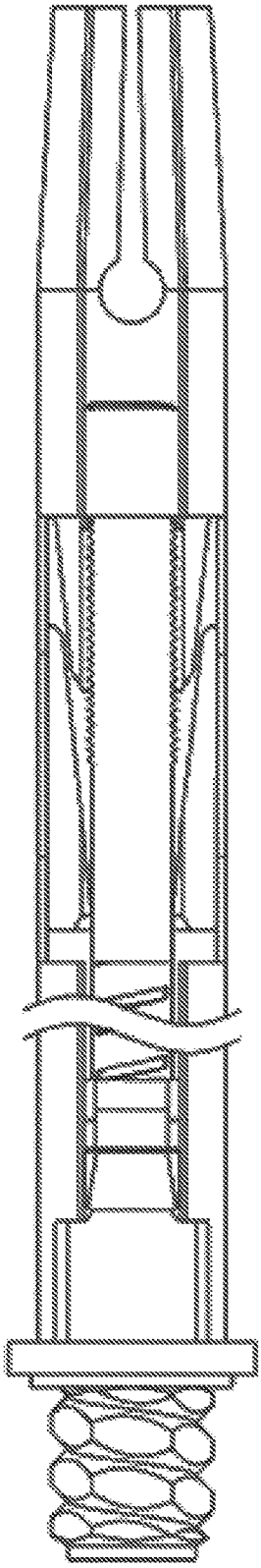
Fig. 1 (prior art)
FIG. 1 shows a prior art rock bolt.
Figure 2A:
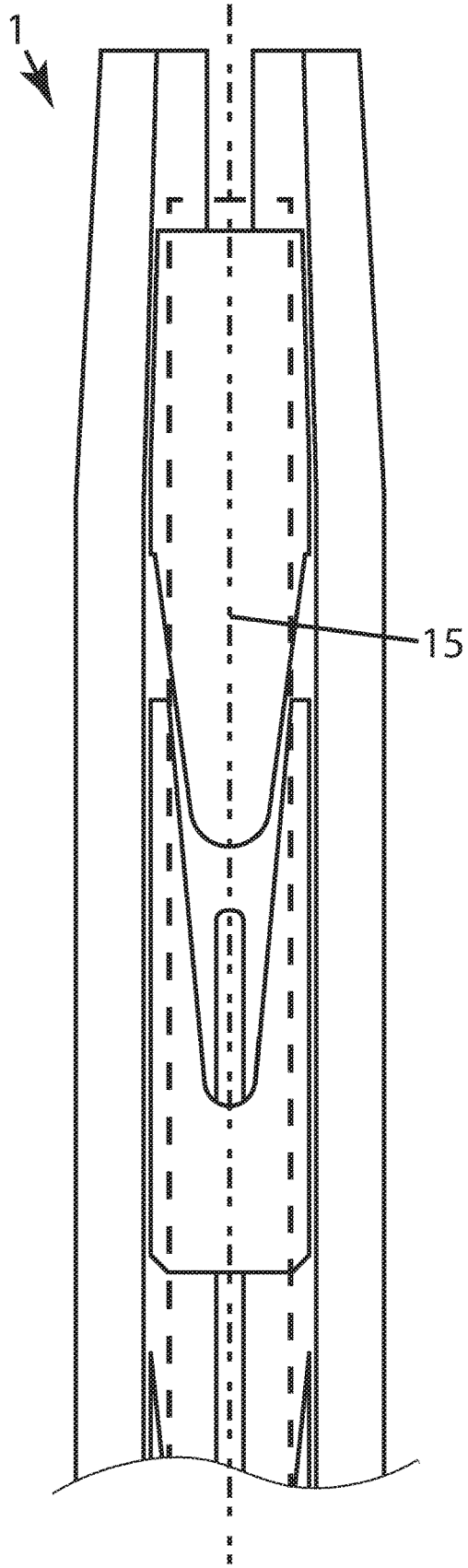
FIGS. 2*a*-2*b* show a leading portion of a rock bolt according to a first embodiment of the present disclosure (central rod shown in dotted lines.
Figure 2B:
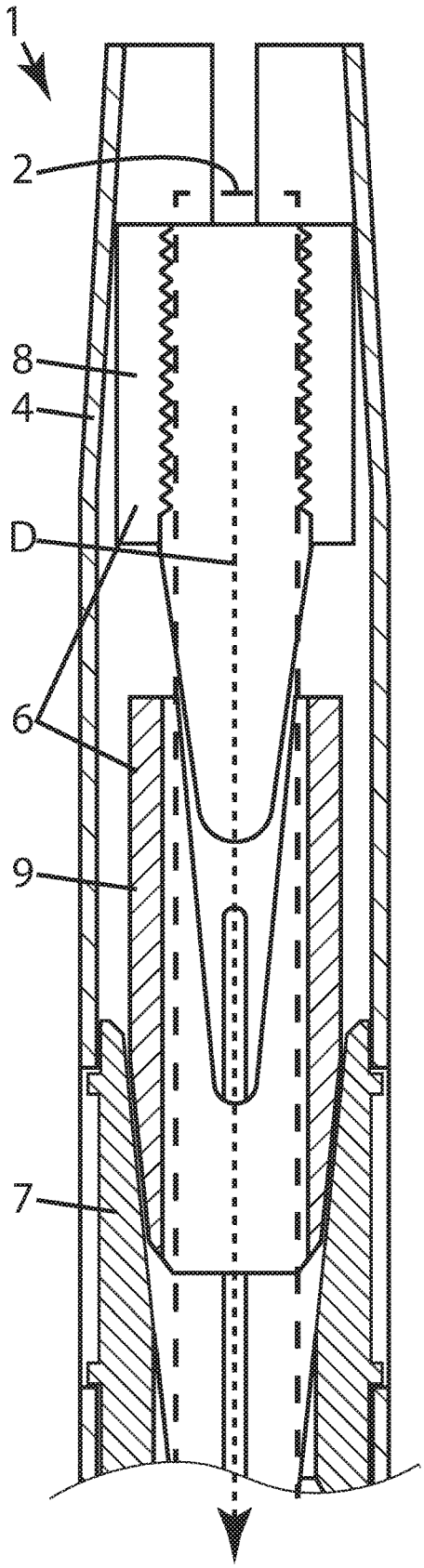

As shown in FIG. 2, the rock bolt 1 comprises a central rod 2, a tubular outer body 4 provided around the central rod 2 along at least a portion of the length of the central rod 2. The rock bolt 1 further comprises an expansion mechanism for radially expanding the tubular outer body 4. In this embodiment, the expansion mechanism is provided at a leading portion of the rock bolt 1 but in other embodiments the expansion mechanism could alternatively be provided further back along the length of the rock bolt 1. The leading portion of the rock bolt 1 is the portion of the rock bolt 1 first inserted in the bore upon installation of the rock bolt 1. The expansion mechanism comprises a first wedge means 6 attached to the central rod 2, and a second wedge means 7 attached to the outer body 4 between the first wedge means 6 and a trailing portion 18 of the outer body 4.

The first wedge means 6 and the second wedge means 7 are configured such that the first wedge means 6 is able to force the second wedge means 7 radially outwards about the longitudinal axis 15 of the rock bolt 1 upon movement of the first wedge means 6 in a first direction D towards the trailing portion 18 of the rock bolt 1 to thereby radially expand the outer body 4. The expansion is achieved by the mutually cooperating inclined wedge surfaces of the first and the second wedge means 6, 7 forcing the second wedge means radially outwards as the first wedge means and second wedge means are moved closed to each other about the longitudinal axis of the rock bolt 1.

According to the present disclosure, the first wedge means 6 comprises a drive wedge 8 attached to the central rod 2 and an intermediate wedge 9 provided around at least a portion of the drive wedge 8, between the drive wedge 8 and the second wedge means 7. The drive wedge 8 and the intermediate wedge 9 are configured such that the drive wedge 8 is able to radially expand the intermediate wedge 9 upon movement of the drive wedge 8 in the first direction D towards the trailing portion 18 of the rock bolt 1, wherein first wedge means 6 is thus able to force the second wedge means 7 radially outwards with the radially expanded intermediate wedge 9.

Although the first wedge means 6 is described as attached to the central rod 2, it is to be understood that it is only the drive wedge 8 of the first wedge means 6 that is attached to the central rod 2 and that the intermediate wedge 9 is movable relative to the central rod 2 but functionally associated with the drive wedge 8 so that they work together. In other words, the first wedge means 6 is 'anchored to' the central rod 2.

Figure 7A:
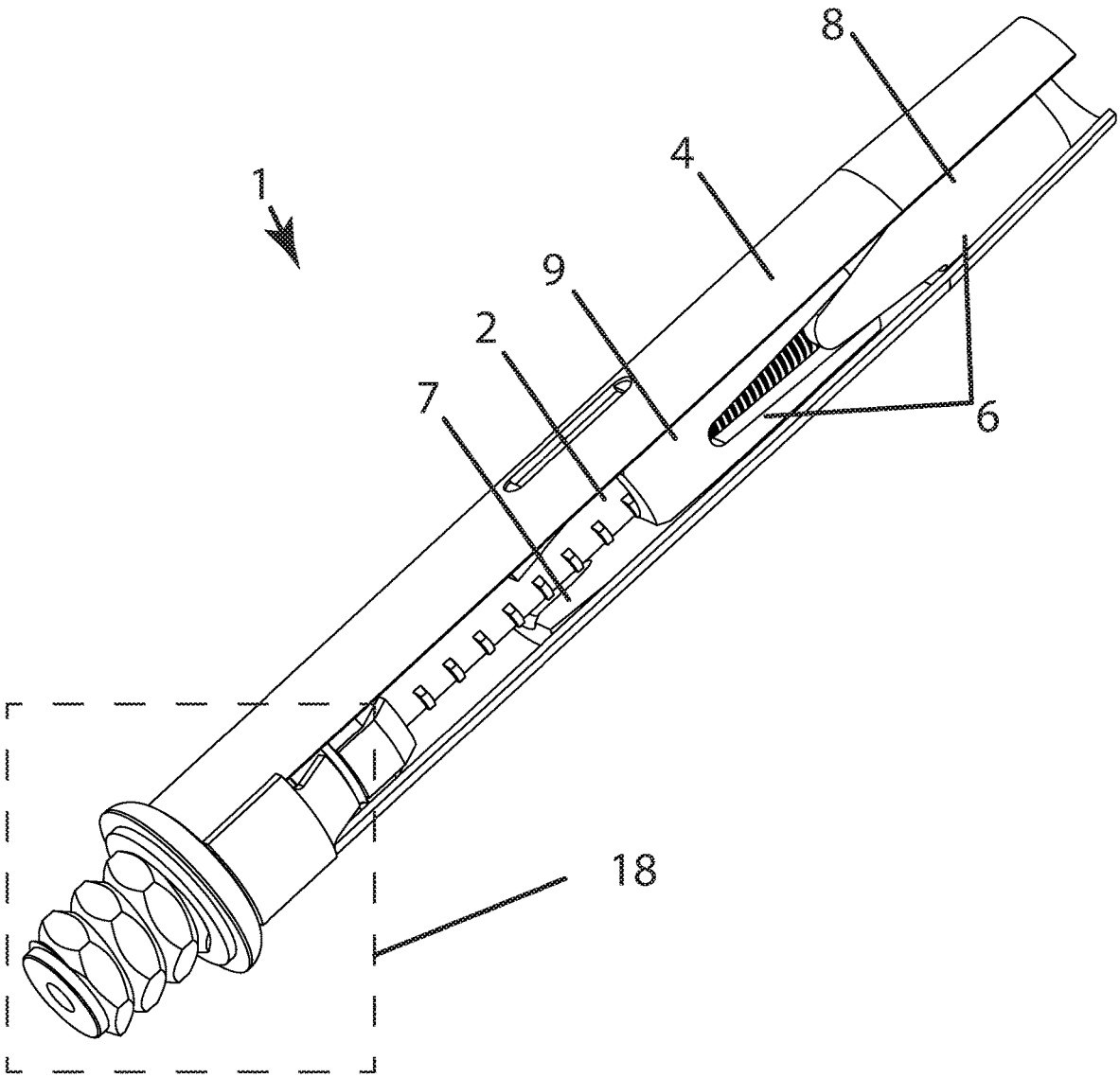
FIGS. 7*a*-*c* show perspective views of an embodiment of the rock bolt with a full view in FIG. 7*a*, a section view in FIG. 7*b* and the section view with the central rod hidden in FIG. 7*c*.
Figure 7B:
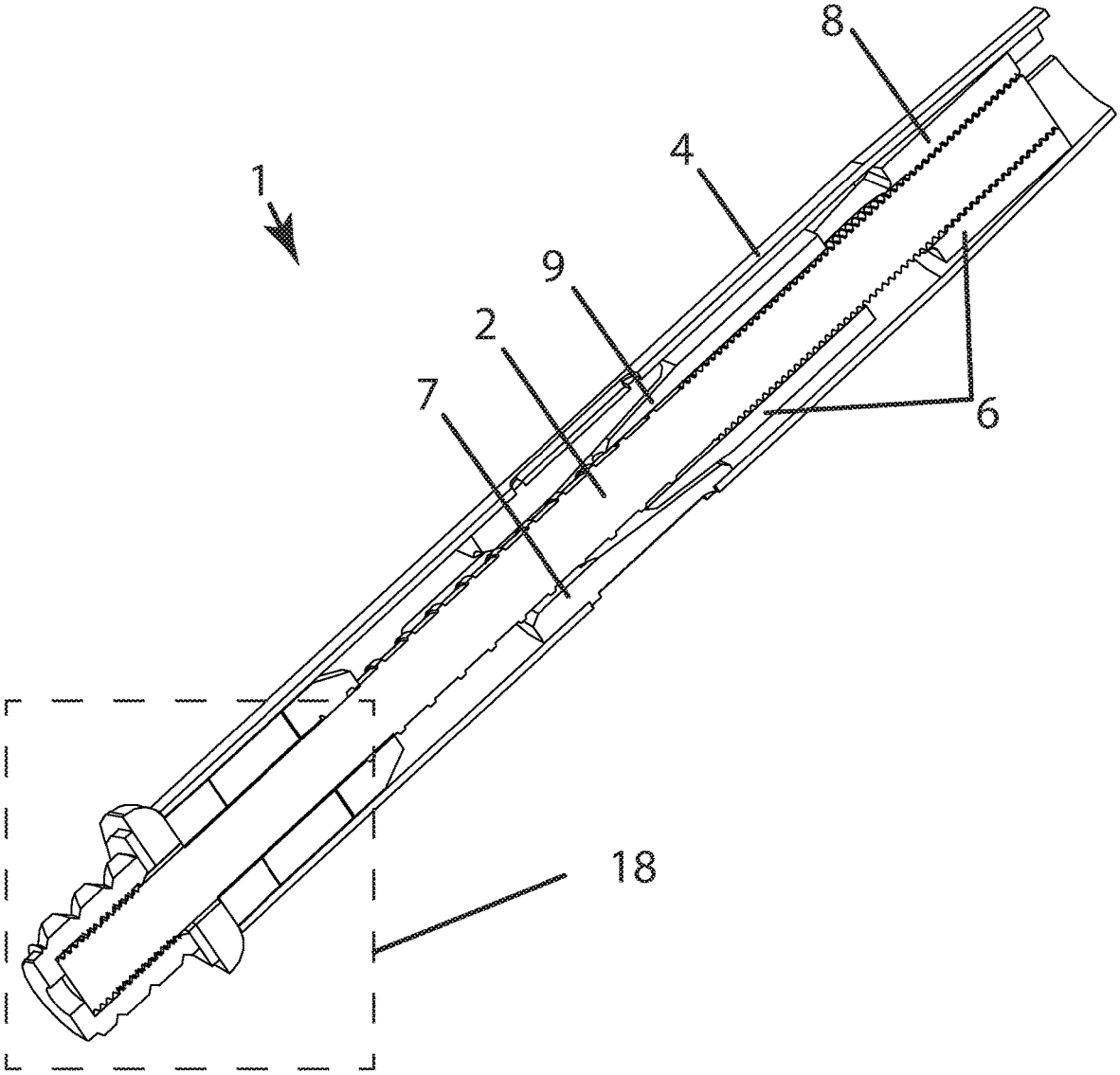
Figure 7C:
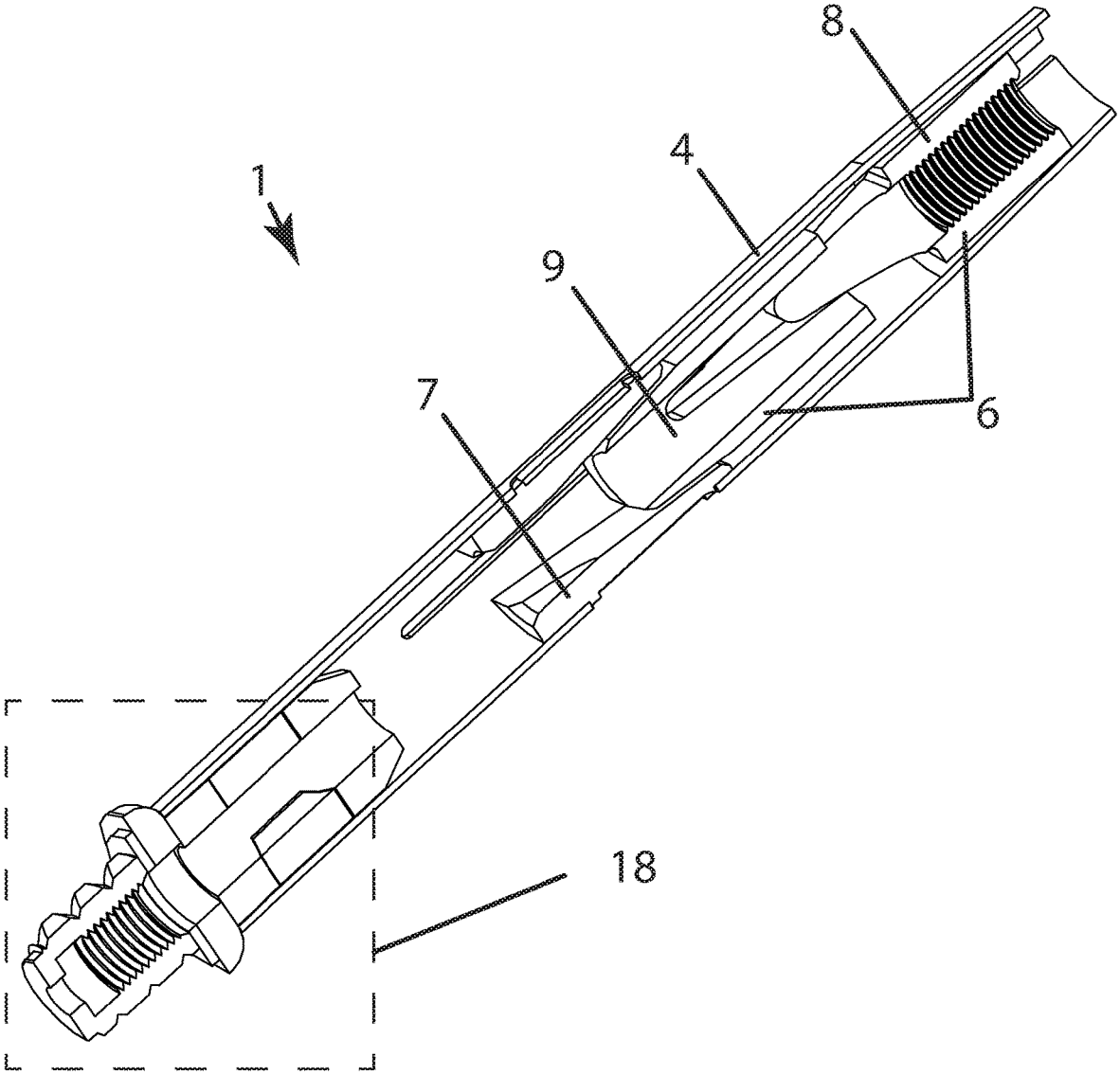

The first wedge means 6 is expanded by moving the drive wedge 8 towards the trailing portion 18 of the rock bolt 1. Such movement is in this embodiment achieved by rotation of the central rod 2 achieved by rotating the blind nut shown in FIGS. 7*a-c* but in other embodiments (not shown in figures) the drive wedge 8 could alternatively be moved without rotating the central rod (i.e. without moving the drive wedge 8 relatively the central rod 2) by moving the central rod 2 towards the trailing portion 18 of the outer body 4, such as by using another type of nut allowing the nut to pull the central rod 2 upon rotation of the nut, i.e. not a blind nut.

The drive wedge 8 is provided with first wedge surfaces 10, and wherein the intermediate wedge 9 is provided with second wedge surfaces 11 for interfacing the first wedge surfaces 10 of the drive wedge 8. The first wedge surfaces 10 are planar and the second wedge surfaces 11 are planar. Here, planar is to be construed as having a portion extending in a respective plane, said portion being the portion of each respective wedge surface active for transmitting wedging force to the corresponding wedge surface of the other one of the first wedge surfaces 10 and the second wedge surfaces 11. Other portions of the drive wedge 8 and of the intermediate wedge 9 may be extend outside of the respective plane.

Figure 5:
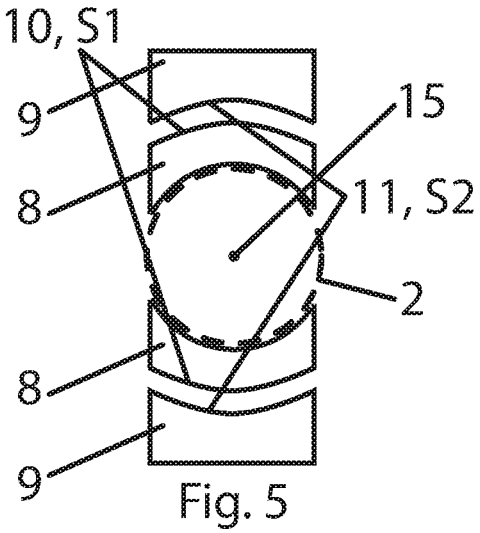
FIG. 5 shows an example of cross-sectional shapes of the interfacing wedge surface of the drive wedge and the intermediate member. Similar interfacing wedge surfaces may be provided between the intermediate member and the second wedge means.

In alternative embodiments, instead of being planar the first wedge surfaces 10 may have a first cross-sectional shape S1 being constant along the length of each respective first wedge surface 10, wherein the second wedge surfaces 11 have a constant second cross-sectional shape S2 being constant along the length of each respective second wedge surface 11, and wherein the first cross-sectional shape S1 fits with the second cross-sectional shape S2. An example of such cross-sectional shapes S1, S2 are shown in FIG. 5, wherein the first wedge surfaces 10 have constant cross-sectional shape perpendicularly to the longitudinal axis of the rock bolt 1, and wherein the second wedge surfaces 11 have constant cross-sectional shape perpendicularly to the longitudinal axis of the rock bolt 1. The constant cross-sectional shape can for example define a planar surface or a surface with arcuate cross-sectional shape.

Figure 3A:
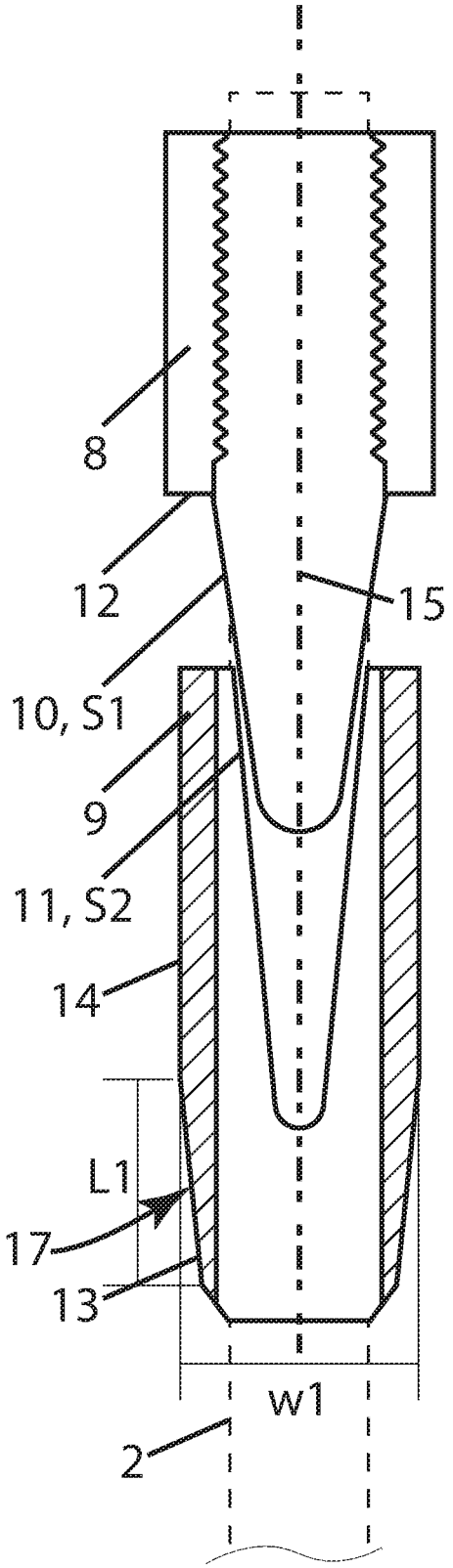
FIGS. 3*a*-3*b* show a first embodiment of the intermediate wedge of the rock bolt of FIGS. 2*a*-2*b*.
Figure 3B:
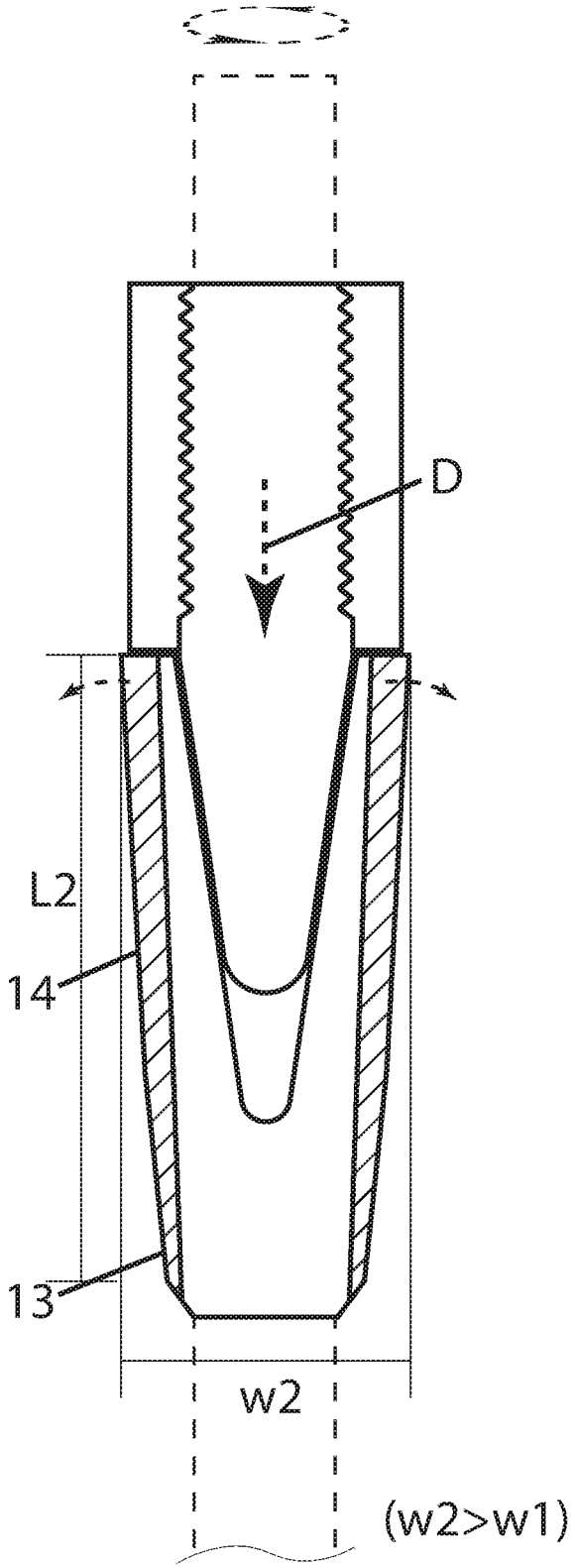

As shown in FIGS. 3*a*-3*b*, the intermediate wedge 9 is provided with one or more outer wedge surfaces 17 comprising a tapering lead-in 13 portion and a rear 14 portion extending along the longitudinal axis 15 of the rock bolt 1. The rear portion 14 is shaped such that when the intermediate wedge 9 is fully expanded the rear portion 14 is aligned with the lead-in portion 13 but may alternatively in other embodiments be shaped not to align with the lead-in portion 13. In yet an alternative embodiment, the intermediate wedge 9 is provided with one or more outer wedge surfaces 17 tapered along a majority of the length of the intermediate wedge 9. The length of the outer wedge surfaces 17 thus increases from a shorter length L1 to a longer length L2 upon expansion of the intermediate wedge 9, as shown in FIGS. 3*a* and 3*b*.

As shown in FIG. 3*a*, the drive wedge 8 comprises at least one shoulder 12 for applying driving force to the intermediate wedge 9 to force the intermediate wedge 9 in the first direction D. The shoulder 12 is configured to enable the intermediate wedge 9 to move relatively the drive wedge 8 from an unexpanded position to an expanded position, and configured to provide a stop surface preventing further relative movement of the intermediate wedge 9 onto the drive wedge 8 past the expanded position. If no such shoulder 12 is provided on the drive wedge 8, further expansion of the intermediate wedge 9 would be possible, thereby enabling further expansion of the second wedge means 7.

Figure 4:
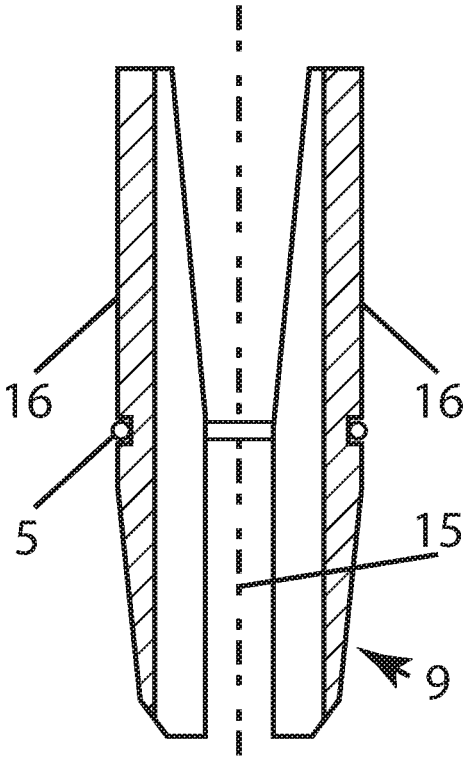
FIG. 4 show an alternative embodiment of the intermediate wedge shown in FIGS. 3*a*-3*b* (multi-part embodiment with a resilient circumferential band to keep the parts aligned.
Figure 6:
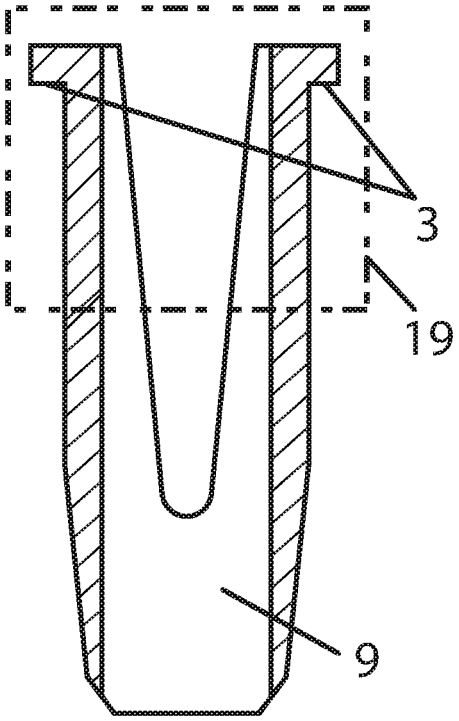
FIG. 6 shows an alternative embodiment of the intermediate wedge provided with a shoulder for limiting its movement relative to the second wedge means along the longitudinal axis of the rock bolt.

The intermediate wedge 9 is made in one piece but may alternatively in other embodiments, such as the one shown in FIG. 4, comprise a plurality of wedge parts 16 (two wedge parts in the FIG. 4 embodiment) distributed about the longitudinal axis 15 of the rock bolt 1. When made in one piece, the one piece could be made by any suitable manufacturing method, such as by molding or by attaching together multiple pieces such as by welding them to form one unitary piece.

When using a plurality of wedge parts 16, the intermediate wedge 9 may preferably comprise resilient retaining means 5 configured to longitudinally align the wedge parts with respect to the longitudinal axis of the rock bolt 1 and configured to allow the wedge parts 16 to radially expand. The retaining means comprises one or more resilient circumferential bands extending about the longitudinal axis 15 of the rock bolt and engaging respective corresponding recesses of the wedge parts 16, said resilient band(s) for example being O-rings.

In an alternative embodiment of the intermediate wedge 9 it is provided with a shoulder 3 at its rear portion for limiting the axial movement of the intermediate wedge 9 along the longitudinal axis 15 of the rock bolt 1 by engagement of the second wedge means 7.

The invention claimed is:

1. A rock bolt comprising:

a central rod;

a tubular outer body provided around the central rod along at least a portion of a length of the central rod, and;

an expansion mechanism arranged for radially expanding the tubular outer body, wherein the expansion mechanism comprises;

a first wedge means attached to the central rod; and a second wedge means attached to the outer body between the first wedge means and a trailing portion of the outer body, wherein the first wedge means and the second wedge means are configured such that the first wedge means is arranged to force the second wedge means radially outwards about a longitudinal axis of the rock bolt upon movement of the first wedge means in a first direction towards a trailing portion of the rock bolt to thereby radially expand the outer body, wherein the first wedge means includes a drive wedge attached to the central rod and an intermediate wedge provided around at least a portion of the drive wedge, between the drive wedge and the second wedge means, wherein the drive wedge and the intermediate wedge are configured such that the drive wedge is arranged to radially expand the intermediate wedge upon movement of the drive wedge in the first direction towards a trailing portion of the rock bolt, wherein first wedge means is thus arranged to force the second wedge means radially outwards with the radially expanded intermediate wedge.

2. The rock bolt according to claim 1, wherein the drive wedge is provided with first wedge surfaces, and wherein the intermediate wedge is provided with second wedge surfaces arranged for interfacing the first wedge surfaces of the drive wedge, wherein the first wedge surfaces are planar and wherein the second wedge surfaces are planar.

3. The rock bolt according to claim 1, wherein the drive wedge is provided with first wedge surfaces, and wherein the intermediate wedge is provided with second wedge surfaces arranged for interfacing with the first wedge surfaces of the drive wedge, wherein the first wedge surfaces have a first cross-sectional shape being constant along a length of each respective first wedge surface, wherein the second wedge surfaces have a constant second cross-sectional shape being constant along a length of each respective second wedge surface, and wherein the first cross-sectional shape fits with the second cross-sectional shape.

4. The rock bolt according to claim 3, wherein the first wedge surfaces have a constant cross-sectional shape perpendicular to the longitudinal axis of the rock bolt, and wherein the second wedge surfaces have a constant cross-sectional shape perpendicular to the longitudinal axis of the rock bolt.

5. The rock bolt according to claim 1, wherein the intermediate wedge is provided with one or more outer wedge surfaces having a tapering lead-in portion and a rear portion extending along the longitudinal axis of the rock bolt.

6. The rock bolt according to claim 5, wherein the rear portion is shaped such that when the intermediate wedge is fully expanded the rear portion is aligned with the lead-in portion.

7. The rock bolt according to claim 1, wherein the intermediate wedge is provided with one or more outer wedge surfaces tapered along a majority of a length of the intermediate wedge.

8. The rock bolt according to claim 1, wherein the drive wedge includes at least one shoulder arranged for applying a driving force to the intermediate wedge to force the intermediate wedge in the first direction.

9. The rock bolt according to claim 8, wherein the shoulder is configured to enable the intermediate wedge to move relatively to the drive wedge from an unexpanded position to an expanded position, and configured to provide a stop surface preventing further relative movement of the intermediate wedge onto the drive wedge past the expanded position.

10. The rock bolt according to claim 1, wherein the intermediate wedge is made in one piece.

11. The rock bolt according to claim 1, wherein the intermediate wedge includes a plurality of wedge parts distributed about the longitudinal axis of the rock bolt.

12. The rock bolt according to claim 11, wherein the intermediate wedge comprises resilient retaining means configured to longitudinally align the wedge parts with respect to the longitudinal axis of the rock bolt and configured to allow the wedge parts to radially expand.

13. The rock bolt according to claim 12, wherein the retaining means includes one or more resilient circumferential bands extending about the longitudinal axis of the rock bolt and engaging respective corresponding recesses of the wedge parts.

14. The rock bolt according to claim 1, wherein the intermediate wedge is provided with a shoulder at its rear portion for limiting the axial movement of the intermediate wedge along the longitudinal axis of the rock bolt by engagement of the second wedge means.

15. The rock bolt according to claim 1, wherein the intermediate wedge and the drive wedge are configured such that at least a portion of the intermediate wedge upon being expanded by the drive wedge abuts the outer body to thereby radially expand the outer body upon further expansion of the intermediate wedge.

* * * * *